US011085299B2

(12) United States Patent
Mathers

(10) Patent No.: US 11,085,299 B2
(45) Date of Patent: Aug. 10, 2021

(54) HYDRAULIC MACHINE WITH CHAMFERED RING

(71) Applicant: Mathers Hydraulics Technologies Pty Ltd, Bridgeman Downs (AU)

(72) Inventor: Norman Ian Mathers, Brisbane (AU)

(73) Assignee: Mathers Hydraulics Technologies Pty Ltd, Bridgeman Downs (AU)

( * ) Notice: Subject to any disclaimer, the term of this patent is extended or adjusted under 35 U.S.C. 154(b) by 248 days.

(21) Appl. No.: 16/063,822

(22) PCT Filed: Dec. 16, 2016

(86) PCT No.: PCT/AU2016/051256
§ 371 (c)(1),
(2) Date: Jun. 19, 2018

(87) PCT Pub. No.: WO2017/106909
PCT Pub. Date: Jun. 29, 2017

(65) Prior Publication Data

US 2020/0270992 A1 Aug. 27, 2020

Related U.S. Application Data

(60) Provisional application No. 62/270,327, filed on Dec. 21, 2015.

(51) Int. Cl.
*F04C 2/344* (2006.01)
*F04C 15/06* (2006.01)
(Continued)

(52) U.S. Cl.
CPC ..... *F01C 1/344* (2013.01); *F01C 21/08* (2013.01); *F01C 21/0809* (2013.01); *F04C 2/344* (2013.01); *F04C 15/06* (2013.01)

(58) Field of Classification Search
CPC ..... F01C 1/344; F04C 2/344
See application file for complete search history.

(56) References Cited

U.S. PATENT DOCUMENTS 983,754 A 2/1911 Nichols
2,003,615 A 6/1935 Smith et al.
(Continued)

FOREIGN PATENT DOCUMENTS

CN 1047551 A 12/1990
CN 1186173 A 7/1998
(Continued)

OTHER PUBLICATIONS

U.S. Appl. No. 13/510,643, filed Dec. 5, 2012, U.S. Pat. No. 9,400,043, Hydrostatic Torque Converter and Torque Amplifier.
(Continued)

*Primary Examiner* — Mary Davis
(74) *Attorney, Agent, or Firm* — Schwegman Lundberg & Woessner, P.A.

(57) ABSTRACT

Various designs for hydraulic devices are disclosed including hydraulic devices that can include a rotor and a ring are disclosed. The rotor can be disposed for rotation about an axis and can have a plurality of plurality of vanes extending therefrom. The ring can be disposed at least partially around the rotor and the ring, and the rotor can be in communication with a port for ingress or egress of the hydraulic fluid to or from adjacent the rotor. The ring defines a cavity adjacent to and in communication with the port, the cavity allows the hydraulic fluid to be disposed adjacent at least one of the plurality of vanes when the at least one of the plurality of vanes is transiting the port.

19 Claims, 8 Drawing Sheets

(51) Int. Cl.
*F01C 1/344* (2006.01)
*F01C 21/08* (2006.01)

(56) References Cited

U.S. PATENT DOCUMENTS

| | | | | |
|---|---|---|---|---|
| 2,570,411 | A | 10/1951 | Vickers | |
| 2,612,110 | A | 9/1952 | Delegard | |
| 2,696,790 | A | 12/1954 | Crow | |
| 2,919,651 | A | 1/1960 | Gardiner | |
| 2,962,972 | A | 12/1960 | Van Meter | |
| 2,962,973 | A | 12/1960 | Pettibone | |
| 2,967,488 | A | 1/1961 | Gardiner | |
| 2,982,223 | A | 5/1961 | Rosaen et al. | |
| 2,985,467 | A | 5/1961 | Cable, Jr. et al. | |
| 3,035,554 | A | 5/1962 | Selzler | |
| 3,042,163 | A | 7/1962 | Lapsley | |
| 3,102,494 | A | 9/1963 | Adams et al. | |
| 3,120,154 | A | 2/1964 | Gilreath | |
| 3,149,845 | A | 9/1964 | Knox | |
| 3,160,147 | A | 12/1964 | Hanson et al. | |
| 3,208,570 | A | 9/1965 | Aschaner | |
| 3,223,044 | A | 12/1965 | Adams et al. | |
| 3,254,606 | A | 6/1966 | Rosaen | |
| 3,320,897 | A | 5/1967 | Eickmann | |
| 3,362,340 | A | 1/1968 | Adams | |
| 3,401,641 | A | 9/1968 | Adams et al. | |
| 3,407,742 | A | 10/1968 | Mitchell et al. | |
| 3,421,413 | A | 1/1969 | Adams et al. | |
| 3,451,346 | A | 6/1969 | Pettibone et al. | |
| 3,525,219 | A | 8/1970 | Minchokovich | |
| 3,533,493 | A | 10/1970 | Braun | |
| 3,578,888 | A | 5/1971 | Adams | |
| 3,586,466 | A | 6/1971 | Erickson | |
| 3,597,998 | A | 8/1971 | Ebert | |
| 3,640,651 | A | 2/1972 | Johnson | |
| 3,790,314 | A | 2/1974 | Swain et al. | |
| 3,792,585 | A | 2/1974 | Eisenmann et al. | |
| 3,895,565 | A | 7/1975 | Schottler | |
| 3,929,356 | A | 12/1975 | Devincent et al. | |
| 3,944,263 | A | 3/1976 | Arnold | |
| 4,037,409 | A | 7/1977 | Leibach | |
| 4,132,512 | A | 1/1979 | Roberts | |
| 4,248,309 | A | 2/1981 | Hofle et al. | |
| 4,260,343 | A | 4/1981 | Watanabe et al. | |
| 4,272,227 | A | 6/1981 | Woodruff et al. | |
| 4,274,010 | A | 6/1981 | Lawson-Tancred | |
| 4,350,220 | A | 9/1982 | Carman | |
| 4,354,809 | A | 10/1982 | Sundberg et al. | |
| D269,454 | S | 6/1983 | Houseman | |
| 4,406,599 | A | 9/1983 | Stephan | |
| 4,412,789 | A | 11/1983 | Ohe et al. | |
| 4,431,389 | A | 2/1984 | Johnson | |
| 4,441,573 | A | 4/1984 | Carman et al. | |
| 4,471,119 | A | 9/1984 | Wright | |
| 4,472,119 | A | 9/1984 | Roberts | |
| 4,505,654 | A | 3/1985 | Dean, Jr. et al. | |
| 4,516,919 | A | 5/1985 | Roberts | |
| 4,629,406 | A | 12/1986 | Tantardini | |
| 4,646,521 | A | 3/1987 | Snyder | |
| 4,659,297 | A | 4/1987 | Kahrs | |
| 4,674,280 | A | 6/1987 | Stuhr | |
| 4,861,235 | A * | 8/1989 | Nakajima | F04C 28/14 417/295 |
| 4,913,636 | A | 4/1990 | Niemiec et al. | |
| 4,963,080 | A | 10/1990 | Hansen | |
| 5,029,461 | A | 7/1991 | Lawrence et al. | |
| 5,064,362 | A | 11/1991 | Hansen et al. | |
| 5,170,636 | A | 12/1992 | Hitosugi | |
| 5,199,750 | A | 4/1993 | Yang | |
| 5,385,458 | A | 1/1995 | Chu | |
| D363,771 | S | 10/1995 | Mathers | |
| 5,509,793 | A | 4/1996 | Cherry | |
| 5,551,484 | A | 9/1996 | Charboneau | |
| D380,039 | S | 6/1997 | Paleczny et al. | |
| 5,655,369 | A | 8/1997 | Folsom et al. | |
| 5,657,629 | A | 8/1997 | Folsom et al. | |
| 5,733,109 | A | 3/1998 | Sundberg et al. | |
| 5,904,043 | A | 5/1999 | Nagatomo | |
| 6,015,278 | A | 1/2000 | Key et al. | |
| 6,056,329 | A | 5/2000 | Kitani et al. | |
| 6,135,742 | A | 10/2000 | Cho et al. | |
| 6,634,865 | B2 | 10/2003 | Dalton | |
| 6,817,438 | B2 | 11/2004 | Modrzejewski et al. | |
| 7,070,399 | B2 | 7/2006 | Konishi et al. | |
| 7,083,394 | B2 | 8/2006 | Dalton | |
| 7,094,044 | B2 | 8/2006 | Strueh | |
| 7,686,602 | B1 | 3/2010 | Landhuis | |
| 7,914,411 | B2 | 3/2011 | Basteck | |
| 7,955,062 | B2 | 6/2011 | Mathers | |
| 8,535,030 | B2 | 9/2013 | Chua et al. | |
| 8,584,452 | B2 | 11/2013 | Lloyd et al. | |
| 8,597,002 | B2 | 12/2013 | Mathers | |
| 8,691,063 | B2 | 4/2014 | Aleksandrov | |
| 8,708,679 | B2 | 4/2014 | Mathers | |
| 9,400,043 | B2 | 7/2016 | Mathers et al. | |
| 10,428,798 | B2 | 10/2019 | Mathers | |
| 10,487,657 | B2 | 11/2019 | Mathers et al. | |
| 10,774,966 | B2 | 9/2020 | Mathers | |
| 10,788,112 | B2 | 9/2020 | Mathers et al. | |
| 2004/0047741 | A1 | 3/2004 | Dalton | |
| 2004/0136853 | A1 | 7/2004 | Clements et al. | |
| 2004/0219046 | A1 | 11/2004 | Johnson et al. | |
| 2006/0133946 | A1 | 6/2006 | Mathers | |
| 2010/0024444 | A1 | 2/2010 | Sharma et al. | |
| 2010/0028181 | A1 | 2/2010 | Mathers | |
| 2010/0028641 | A1 | 2/2010 | Zhu et al. | |
| 2010/0154402 | A1 | 6/2010 | Cho | |
| 2010/0244447 | A1 | 9/2010 | Gopalswamy et al. | |
| 2011/0056195 | A1 | 3/2011 | Lloyd | |
| 2012/0023923 | A1 | 2/2012 | Peters et al. | |
| 2013/0067899 | A1 | 3/2013 | Mathers | |
| 2014/0062088 | A1 | 3/2014 | Carr | |
| 2014/0138958 | A1 | 5/2014 | Verdegem | |
| 2014/0291045 | A1 | 10/2014 | Collett et al. | |
| 2015/0184641 | A1 | 7/2015 | Crane et al. | |
| 2015/0338003 | A1 | 11/2015 | Saito et al. | |
| 2016/0178014 | A1 | 6/2016 | D'angelo et al. | |
| 2016/0178104 | A1 | 6/2016 | Queau et al. | |
| 2016/0194959 | A1 | 7/2016 | Pekrul | |
| 2018/0010676 | A1 | 1/2018 | Mathers et al. | |
| 2018/0023738 | A1 | 1/2018 | Mathers | |
| 2020/0011180 | A1 | 1/2020 | Mathers | |

FOREIGN PATENT DOCUMENTS

| | | | | |
|---|---|---|---|---|
| CN | 1226958 | A | 8/1999 | |
| CN | 2388461 | Y | 7/2000 | |
| CN | 1573112 | A | 2/2005 | |
| CN | 1833901 | A | 9/2006 | |
| CN | 2924153 | Y | 7/2007 | |
| CN | 101081596 | A | 12/2007 | |
| CN | 101233297 | B | 9/2010 | |
| CN | 101949478 | A | 1/2011 | |
| CN | 102562208 | A | 7/2012 | |
| CN | 103052796 | A | 4/2013 | |
| CN | 103510988 | A | 1/2014 | |
| CN | 103511219 | A | 1/2014 | |
| CN | 103672246 | A | 3/2014 | |
| CN | 103758976 | A | 4/2014 | |
| CN | 103836093 | A | 6/2014 | |
| CN | 104471251 | A | 3/2015 | |
| CN | 107428241 | A | 12/2017 | |
| CN | 110023667 | A | 7/2019 | |
| CN | 110382822 | A | 10/2019 | |
| CN | 107709704 | B | 4/2020 | |
| CN | 108431406 | B | 7/2020 | |
| DE | 1653801 | A1 | 6/1971 | |
| DE | 1728268 | A1 | 3/1972 | |
| DE | 2165530 | A1 | 7/1973 | |
| DE | 4136151 | A1 | 5/1993 | |
| DE | 19829726 | A1 * | 1/2000 | F04C 15/0049 |
| DE | 102011082725 | A1 | 3/2013 | |
| DE | 102012013152 | A1 | 1/2014 | |
| EP | 0051192 | A1 | 5/1982 | |

(56) References Cited

FOREIGN PATENT DOCUMENTS

| | | | |
|---|---|---|---|
| EP | 0087401 | A1 | 8/1983 |
| EP | 0384335 | A1 | 8/1990 |
| EP | 0399387 | A2 | 11/1990 |
| EP | 0399387 | B1 | 9/1992 |
| EP | 2501950 | B1 | 7/2000 |
| EP | 1536138 | A1 | 6/2005 |
| EP | 1779903 | B1 | 3/2010 |
| FR | 2944071 | A3 | 10/2010 |
| GB | 1513208 | A | 6/1978 |
| GB | 2015084 | A | 9/1979 |
| GB | 2042642 | A | 9/1980 |
| GB | 2176537 | A | 12/1986 |
| GB | 2481365 | A | 12/2011 |
| IN | 5265DELNP2012 | A1 | 8/2016 |
| IN | 201717028529 | A | 10/2017 |
| IN | 201717036365 | A | 12/2017 |
| IN | 201817018393 | A | 9/2018 |
| IN | 201917006576 | A | 5/2019 |
| IN | 201917036435 | A | 11/2019 |
| JP | S5322204 | U | 2/1978 |
| JP | S55112085 | U | 8/1980 |
| JP | S62113883 | A | 5/1987 |
| JP | H05263413 | A | 10/1993 |
| JP | H0710483 | A | 1/1995 |
| JP | H07310687 | A | 11/1995 |
| JP | 2002275979 | A | 9/2002 |
| JP | 2003172272 | A | 6/2003 |
| JP | 2005351117 | A | 12/2005 |
| JP | 2008540905 | A | 11/2008 |
| JP | 2009539006 | A | 11/2009 |
| JP | 5200009 | A | 2/2013 |
| KR | 20140023133 | A | 2/2014 |
| RU | 1807460 | A1 | 4/1993 |
| WO | WO-1981001444 | A1 | 5/1981 |
| WO | WO-9111614 | A1 | 8/1991 |
| WO | WO-199401179 | A1 | 1/1994 |
| WO | WO-9508047 | A1 | 3/1995 |
| WO | WO-9801670 | A1 | 1/1998 |
| WO | WO-0204812 | A1 | 1/2002 |
| WO | WO-2004000951 | A1 | 12/2003 |
| WO | WO-2005005782 | A1 | 1/2005 |
| WO | WO-2006119574 | A1 | 11/2006 |
| WO | WO-2007140514 | A1 | 12/2007 |
| WO | WO-2011005100 | A1 | 1/2011 |
| WO | WO-2011011682 | A2 | 1/2011 |
| WO | WO-2012015850 | A1 | 2/2012 |
| WO | WO-2013140305 | A1 | 9/2013 |
| WO | WO-2015123784 | A1 | 8/2015 |
| WO | WO-2016065392 | A1 | 5/2016 |
| WO | WO-2017106909 | A1 | 6/2017 |
| WO | WO-2018014082 | A1 | 1/2018 |
| WO | WO-2018161108 | A1 | 9/2018 |

OTHER PUBLICATIONS

U.S. Appl. No. 14/599,746, filed Jan. 19, 2015, U.S. Pat. No. 9,874,270, Hydrostatic Torque Converter and Torque Amplifier.
U.S. Appl. No. 16/867,943, filed May 6, 2020, Hydrostatic Torque Converter and Torque Amplifier.
U.S. Appl. No. 11/914,203, filed Jul. 1, 2008, U.S. Pat. No. 7,955,062, Vane Pump.
U.S. Appl. No. 12/466,208, filed May 14, 2009, U.S. Pat. No. 8,597,002, Hydraulic Machine With Vane Retaining Mechanism.
U.S. Appl. No. 14/095,654, filed Dec. 3, 2013, U.S. Pat. No. 9,638,188, Hydraulic Machine With Vane Retaining Mechanism.
U.S. Appl. No. 12/303,224, filed Jun. 16, 2009, U.S. Pat. No. 8,708,679, Vane Pump for Pumping Hydraulic Fluid.
U.S. Appl. No. 29/099,122, filed Jan. 13, 1999, U.S. Pat. No. D. 447,222, Seal.
U.S. Appl. No. 11/331,356, filed Jan. 13, 2006, A Hydraulic Machine.
U.S. Appl. No. 15/544,829, filed Jul. 19, 2017, Hydro-Mechanical Transmission With Multiple Modes of Operation.
U.S. Appl. No. 15/561,410, filed Sep. 25, 2017, U.S. Pat. No. 10,487,657, Hydraulic Machine.
U.S. Appl. No. 15/767,902, filed Apr. 12, 2018, U.S. Pat. No. 10,428,798, Wind Turbine Power Storage and Regeneration.
U.S. Appl. No. 15/654,418, filed Jul. 19, 2017, Hydraulic Joint.
U.S. Appl. No. 16/491,112, filed Sep. 4, 2019, Hydraulic Machine With Stepped Roller Vane and Fluid Power System Including Hydraulic Machine With Starter Motor Capability.
"European Application Serial No. 16876998.2, Response filed Aug. 3, 2018", 13 pgs.
"International Application Serial No. PCT/AU2016/051256, International Preliminary Report on Patentability dated Jul. 5, 2018", 8 pgs.
"International Application Serial No. PCT/AU2016/051256, International Search Report dated Apr. 24, 2017", 6 pgs.
"International Application Serial No. PCT/AU2016/051256, Written Opinion dated Apr. 24, 2017", 6 pgs.
"European Application Serial No. 16876998.2, Extended European Search Report dated Jun. 12, 2019", 8 pgs.
U.S. Appl. No. 15/835,058, filed Dec. 7, 2017, U.S. Pat. No. 10,670,125, Hydrostatic Torque Converter and Torque Amplifier.
U.S. Appl. No. 16/990,789, filed Aug. 11, 2020, Hydraulic Joint.
"U.S. Appl. No. 15/544,829, 312 Amendment filed Jul. 17, 2020", 7 pgs.
"U.S. Appl. No. 15/544,829, PTO Response to Rule 312 Communication dated Jul. 31, 2020", 2 pgs.
"U.S. Appl. No. 16/687,943, Preliminary Amendment filed Jul. 8, 2020", 6 pgs.
"U.S. Appl. No. 16/990,789, Preliminary Amendment filed Sep. 16, 2020", 7 pgs.
"Australian Application Serial No. 2016343296, First Examination Report dated Jul. 10, 2020", 4 pgs.
"Australian Application Serial No. 2016343296, Response filed Oct. 1, 2020 to First Examination Report dated Jul. 10, 2020", 33 pgs.
"Australian Application Serial No. 2019200036, Response filed May 15, 2020 to Subsequent Examiners Report dated Apr. 8, 2020", 8 pgs.
"Chinese Application Serial No. 201680074851.8, Office Action dated Apr. 24, 2020", w/ English Translation, 25 pgs.
"Chinese Application Serial No. 201680074851.8, Response filed Aug. 6, 2020 to Office Action dated Apr. 24, 2020", w/ English Claims, 43 pgs.
"Chinese Application Serial No. 201780055270.4, Office Action dated Apr. 16, 2020", w/ English Translation, 21 pgs.
"Chinese Application Serial No. 201780055270.4, Response filed Aug. 11, 20-20 to Office Action dated Apr. 16, 2020", w/ English Claims, 24 pgs.
"Eurasian Application Serial No. 201791637, Office Action dated May 15, 2020", w/ English Translation, 7 pgs.
"Eurasian Application Serial No. 201791637, Response filed Sep. 16, 2020 to Office Action dated May 15, 2020", w/ English Claims, 48 pgs.
"Eurasian Application Serial No. 201891483, Office Action dated Jun. 8, 2020", w/ English Translation, 4 pgs.
"Eurasian Application Serial No. 201891483, Response filed Jan. 22, 2020 to Office Action dated Sep. 27, 2019", w/ English Claims, 7 pgs.
"European Application Serial No. 18763798.8, Response filed May 28, 2020 to Extended European Search Report dated Jan. 3, 2020", 16 pgs.
"European Application Serial No. 20175416.5, Extended European Search Report dated Sep. 9, 2020", 6 pgs.
"Indian Application Serial No. 201717028529, First Examination Report dated Aug. 31, 2020", w/ English Translation, 6 pgs.
"Indian Application Serial No. 201717036365, Office Action dated Aug. 17, 2020", w/ English Translation, 5 pgs.
"Indian Application Serial No. 201817026903, First Examination Report dated Jul. 30, 2020", w/ English Translation, 7 pgs.
"International Application Serial No. PCT/AU2020/050389, International Search Report dated Jun. 22, 2020", 4 pgs.
"International Application Serial No. PCT/AU2020/050389, Written Opinion dated Jun. 22, 2020", 6 pgs.

(56) References Cited

OTHER PUBLICATIONS

"U.S. Appl. No. 11/914,203, Preliminary Amendment filed Nov. 12, 2007", 8 pgs.
"U.S. Appl. No. 12/303,224, Non Final Office Action dated Jan. 19, 2012", 10 pgs.
"U.S. Appl. No. 12/303,224, Preliminary Amendment filed Dec. 2. 2008", 5 pgs.

* cited by examiner

HYDRAULIC MACHINE WITH CHAMFERED RING

CROSS REFERENCE TO RELATED APPLICATIONS AND PRIORITY CLAIM

The present application is related to international application no. PCT/AU2007/000772, publication no. WO/2007/140514, entitled "Vane Pump for Pumping Hydraulic Fluid," filed Jun. 1, 2007; international application no. PCT/AU2006/000623, publication no. WO/2006/119574, entitled "Improved Vane Pump," filed May 12, 2006; international application no. PCT/AU2004/00951, publication no. WO/2005/005782, entitled "A Hydraulic Machine," filed Jul. 15, 2004; and U.S. patent application Ser. No. 13/510,643, publication no. U.S. 2013/0067899, entitled "Hydraulically Controlled Rotator Couple," filed Dec. 5, 2012, the entire specification of each of which is incorporated herein by reference in entirety. This application is a U.S. National Stage Filing under 35 U.S.C. 371 from International Application No. PCT/AU2016/051256, filed on 16 Dec. 2016, and published as WO 2017/106909, which application claims the benefit of priority to U.S. Provisional Patent Application Ser. No. 62/270,327, filed 21 Dec. 2015, the disclosure of which is incorporated herein in its entirety by reference.

BACKGROUND

Hydraulic vane pumps are used to pump hydraulic fluid in many different types of machines for different purposes. Such machines include, for example, transportation vehicles, agricultural machines, industrial machines, and marine vehicles (e.g., trawlers).

Rotary couplings are also utilized in transportation vehicles, industrial machines, and agricultural machines to transmit rotating mechanical power. For example, they have been used in automobile transmissions as an alternative to a mechanical clutch. Use of rotary couplings is also widespread in applications where variable speed operation and controlled start-up.

OVERVIEW AND TECHNICAL FIELD

The present patent application relates generally to hydraulic devices, and more particularly, to hydraulic machines that include rollers. Hydraulic devices are disclosed herein including those with fixed or variable vanes having rollers. The hydraulic devices can include vane couplings and pumps. According to some examples, the rollers of the hydraulic devices can slide axially in an undesirable manner. To prevent this the inventors proposed modification of a side plate to act as a stop to prevent such movement. In some cases, such modification to the side plate can restricted the lubricant path in suction port, which can lead to cavitation and failure of the hydraulic device. Thus, the inventors further propose the cam ring can be chamfered to make up for any loss of port area due to the addition of the stop in the suction port area. The chamfered cam ring can further allow for unrestricted passage of lubricant in the suction port area. As such, the relief provided by the cavity can help keep the roller of the vanes from being slide out into the suction and pressure cut away in the side plates creating lock up or severe damage.

The present inventors have recognized that hydraulic devices with vanes can offer improved power density and service life as compared to traditional variable piston pump/motor hydraulic devices. Such traditional variable piston hydraulic devices can be larger per flow rate than variable vane hydraulic devices, making them difficult to fit in smaller engine bays. Furthermore, the present inventors have recognized that variable piston hydraulic devices take rotary energy and transfer it to axial energy then to pressurized hydraulic flow to do work. Such conversions result in power loss. In contrast, a vane hydraulic device with vanes can convert rotary energy directly to pressurized flow reducing the number of conversions, and hence, the number of power losses.

Variable and fixed vane hydraulic devices can utilize vanes with rollers on the tip. The present inventors have recognized that these roller vanes are subject to forces in the inlet and outlet port areas that can cause the rollers to axially slide or otherwise shift position in their vane cavities and interfere with side plates that define the inlet and outlet ports. Thus, the present inventors propose designs for the ring and the side plate that can prevent shifting or movement of the rollers while still allowing hydraulic fluid to flow to or from adjacent the rotor in an unrestricted manner.

According to some examples, the hydraulic devices can include a rotor and a ring. The rotor can be disposed for rotation about an axis and can have a plurality of circumferentially spaced slots configured to house a plurality of vanes therein. With a variable vane hydraulic device, the plurality of vanes can be configured to be movable between a retracted position and an extended position where the plurality of vanes work a hydraulic fluid introduced adjacent the rotor. With a fixed vane device the position of the vanes relative the rotor remains the same.

The ring can be disposed at least partially around the rotor and the ring and the rotor can be in communication with a port for ingress or egress of the hydraulic fluid to or from adjacent the rotor. The ring is chamfered adjacent the port to define a cavity that allows the hydraulic fluid to be disposed adjacent at least one of the plurality of vanes when the at least one of the plurality of vanes is transiting the port.

Additional examples contemplate wherein the cavity can be configured to allow the hydraulic fluid to be disposed radially outward of the at least a portion of one of the plurality of vanes when the at least one of the plurality of vanes is transiting the port. The cavity can be defined by the rotor and can be configured to allow the hydraulic fluid to be disposed radially outward of at least a portion of the at least one of the plurality of vanes when the at least one of the plurality of vanes is transiting the port. The cavity can extend axially along and is defined by an inner surface of the ring. The cavity can extend to a second port on an outer radial surface of the ring. The cavity can extend along an inner circumference of the ring for a distance sufficient to accommodate at least two of the plurality of vanes when the at least two of the plurality of vanes are transitioning the port. The plurality of vanes can comprise roller vanes each of the roller vanes having a vane cavity on an outer radial end and roller configured to be received in the vane cavity, A rail (e.g. a stop) can be disposed within the port axial to and adjacent the rotor. The rail can be formed by a side plate of the hydraulic device. The rail can be configured to provide an axial stop for the roller of each of the roller vanes. The rail can define one or more passages that allow for a flow of hydraulic fluid through the rail to or from the port. The one or more passages can be are disposed radially inward of the vane cavity and roller. The one or more passages can comprise a slit and/or a plurality of hole. The slit can have a geometry that changes along a circumferential length of the port.

These and other examples and features of the present devices, systems, and methods will be set forth in part in the following Detailed Description. This overview is intended to provide a summary of subject matter of the present patent application. It is not intended to provide an exclusive or exhaustive removal of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

The present application relates to a variable vane hydraulic devices that utilize roller vanes. According to some examples, the hydraulic devices can include a cam ring that is chamfered (i.e. machined) or otherwise formed to create a cavity adjacent a port of the hydraulic device. The relief provided by the cavity can help keep the roller on the variable vanes from adhering or otherwise becoming stuck to the ring in the vicinity of the port. Further examples are provided that disclose a rail that acts as an axial stop for the roller. The rail can prevent axial shifting or movement of the rollers while still allowing hydraulic fluid to flow to or from adjacent the rotor.

Figure 1:
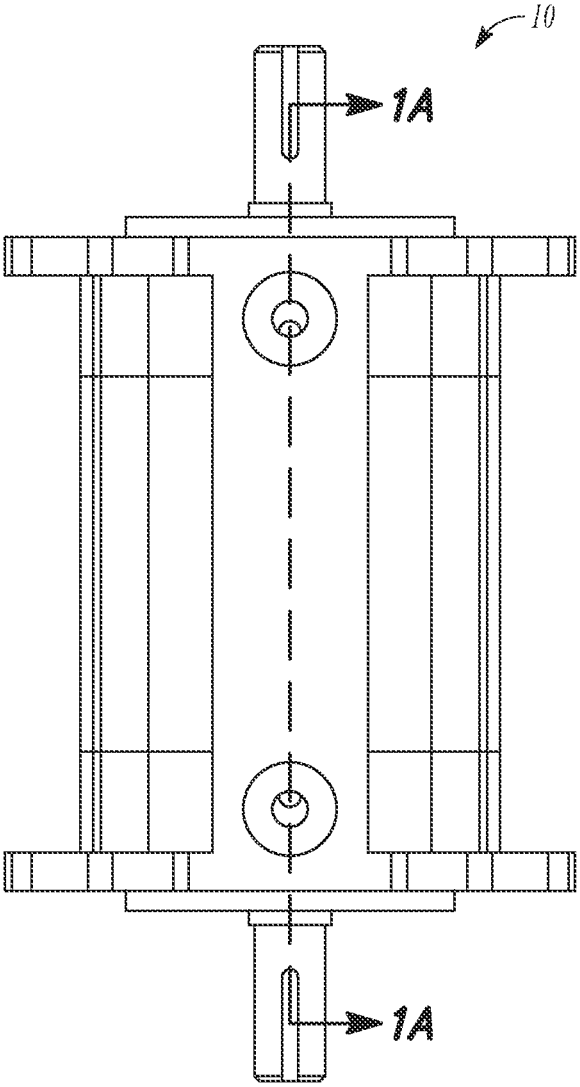
FIG. 1 is a plane view a hydraulic device according to an example of the present application.
Figure 1A:
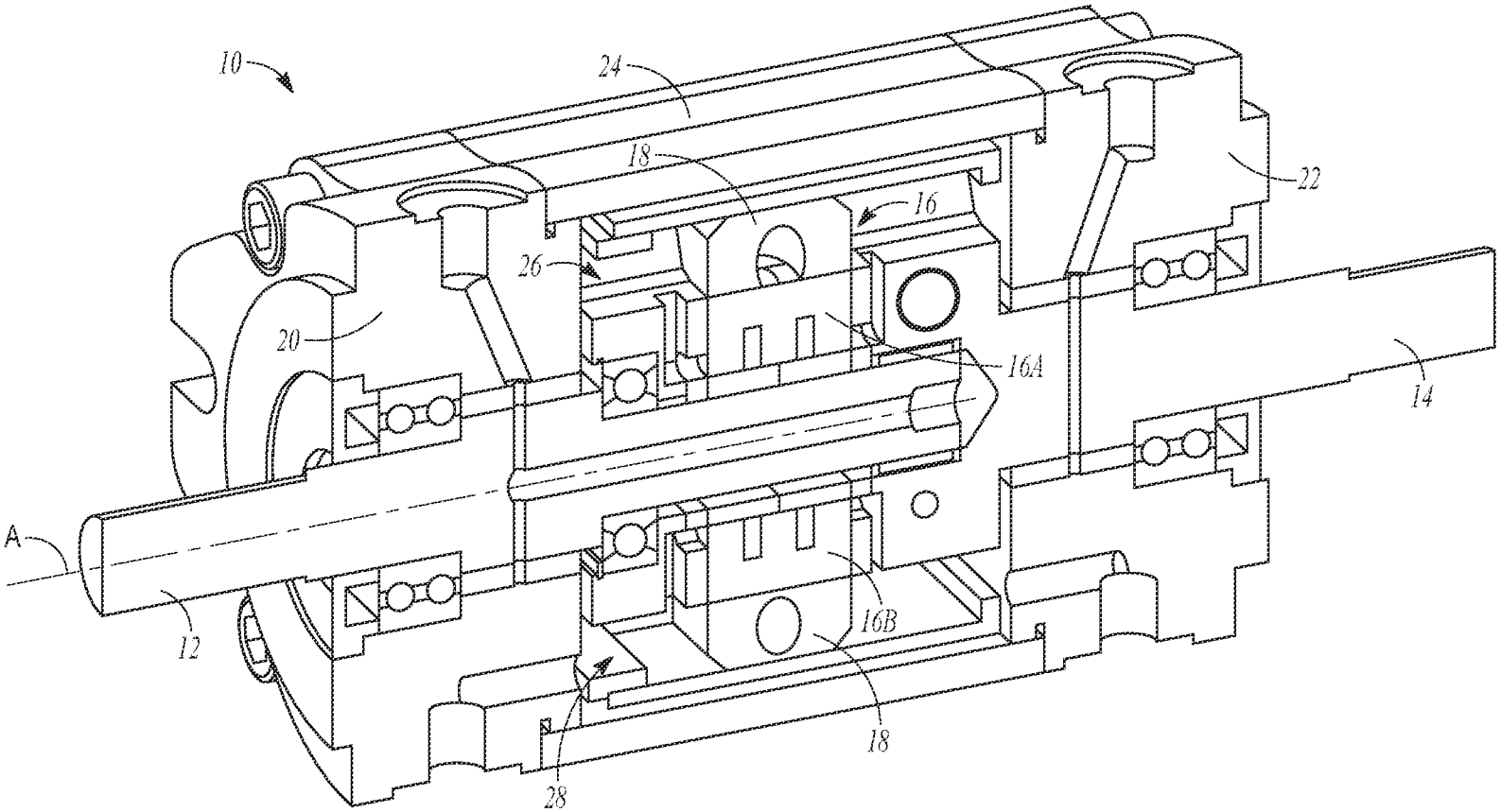
FIG. 1A is a cross section of the hydraulic device of FIG. 1 taken along the line 1A-1A according to an example of the present application.

FIGS. 1 and 1A show an exemplary hydraulic device 10 for hydraulic pumping and/or torque transfer as a hydraulic coupling. In FIGS. 1 and 1A, the hydraulic device 10 comprises a variable vane hydraulic device. Further information on the construction and operation of variable vane hydraulic devices such as those disclosed herein can be found, for example, in United States Patent Application Publication 2013/0067899A1 and U.S. Pat. Nos. 7,955,062, 8,597,002, and 8,708,679 owned by the Applicant and incorporated herein by reference.

As shown in FIG. 1A, the hydraulic device 10 can include an input shaft 12, an output shaft 14, a rotor 16, a first vane 16A and second vane 16B, a ring 18, a first side plate 20, a second side plate 22, a housing 24, a first port 26, and a second port 28.

The input shaft 12 can extend into the hydraulic device 10 and can extend to adjacent the output shaft 14. The rotor 16 can be coupled for rotation with the input shaft 12. The ring 18 can be disposed at least partially around the rotor 16 (e.g., can interface therewith). The first side plate 20 can be disposed about the input shaft 12 axially adjacent to the rotor 16 and the ring 18. The second side plate 22 can be disposed about the output shaft 14 axially adjacent the rotor 16 and the ring 18. The housing 24 (e.g., a sleeve) can be disposed between and connected to the first side plate 20 and the second side plate 22, radially outward of the ring 18. The first port 26 can be defined by the first side plate 20, the housing 24, the ring 18, and the rotor 16. Similarly, the second port 28 can be can be defined by the first side plate 20, the housing 24, the ring 18, and the rotor 16. The first port 26 can be disposed on an opposing radial side of the hydraulic device 10 from the second port 28.

The rotor 16 can be disposed for rotation about an axis A same axis of rotation as the input shaft 12). As used herein, the terms "radial" and "axial" are made in reference to axis A. As will be illustrated in subsequent FIGURES, the rotor 16 can have a plurality of circumferentially spaced slots. The slots can be configured to house a plurality of vanes including the first vane 16A and the second vane 16B therein. In some cases such as a variable vane application, the plurality of vanes (including the first vane 16A and the second vane 16B) can be configured to be radially movable between a retracted position and an extended position where the plurality of vanes work a hydraulic fluid introduced adjacent the rotor 16 (e.g., in a chamber defined between the rotor 16 and the ring 18). In other embodiments, the position of the vanes 16A, 16B can be fixed relative to the rotor 16.

The ring 18 and the rotor 16 can be in communication with the first and/or second ports 26, 28 to allow for ingress or egress of the hydraulic fluid to or from adjacent the rotor 16. As will be discussed in further detail subsequently, the ring 18 can be chamfered (i.e., machined) or otherwise formed along an inner surface adjacent to and in communication with the first and/or second ports 26, 28 to define a cavity 30 (FIG. 1B) that allows the hydraulic fluid to be disposed adjacent at least one of the plurality of vanes (e.g., the first vane 16A and second vane 16B) when the at least one of the plurality of vanes is transiting the first and/or second ports 26, 28. This configuration can to make up for any loss of port area due to the addition of a stop (also referred to as a rail-discussed subsequently) in the port area. The chamfered ring 18 can provide for unrestricted passage of lubricant in the suction port area in some embodiments without interference from the rail.

Figure 1B:
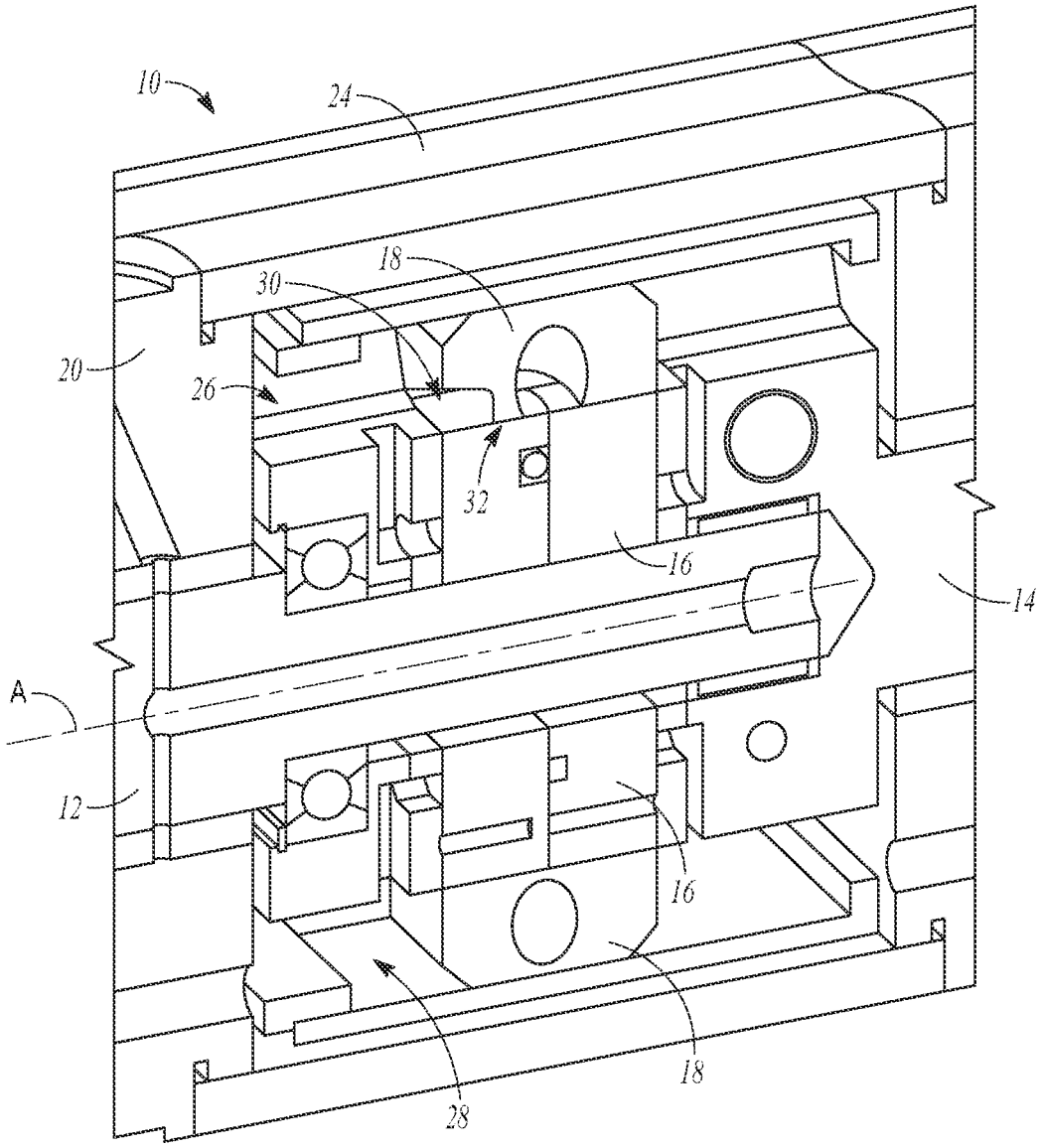
FIG. 1B is an enlarged partial cross section of the hydraulic device of FIG. 1A according to an example of the present application.

The input shaft 12 can be to a torque source (e.g. an engine, motor, or the like). The output shaft 14 can be coupled to a powertrain. In operation, the ring 18 can define a chamber 32 (FIGS. 1B and 2B) in fluid communication with an inlet and a discharge pressure of the hydraulic device 10. According to the illustrated example of FIG. 1A, a rotating group that includes the rotor 16 and the input shaft 10 are configured to rotate around the axis A inside the chamber 32 (FIGS. 1B and 2B). As is further illustrated in FIG. 2B, the rotor 16 in a variable vane configuration can defines a plurality of slots 34 extending generally parallel to the axis A along an exterior of the rotor and opening to the chamber 32 and adapted to receive and retain the plurality of vanes including the first vane 16A and second vane 16B. Various examples can include a hydraulically controlled retainer (not shown) disposed in a retainer passage to retain the plurality of vanes in a retracted vane mode of operation and to release the first vane in a vane extended mode of operation in which the plurality of vanes extend to meet the ring 18 to work the hydraulic fluid. Thus, the plurality of vanes and rotor 16 are radially moveable with respect to the ring 18. In various examples, the output shaft 14 is provided with torque as a result of the worked hydraulic fluid in the vane extended mode of operation. The operation modes can be controlled, for example, via a fluid signal transmitted to the hydraulic device 10 via a port (e.g., one of the first and/or second ports 26, 28 or another port). As discussed previously, the concepts discussed herein are also applicable to a fixed vane configuration where the vanes have a fixed height relative to the rotor 16.

In various examples, the second port 28 can allow oil, glycol, water/glycol, or other hydraulic fluid into and out of the hydraulic device. In some examples, fluid is to flow to and from a separate reservoir. Alternatively, some examples use a large housing that can accommodate enough fluid for operation and cooling. In some examples, the first port 26 is used to engage and disengage the plurality of vanes with the ring 18 to drive by restraining and releasing the plurality of vanes. In some examples, the first port 26 connects through passage via a bushing into the rotor 16. This can allow the plurality of vanes (including the first vane 16A and second vane 16B) to be either restrained or released, such as by moving retainers. One example of vane retraction or release is set forth in US Patent Application Publication No. 2006/0133946, commonly assigned and incorporated herein by reference. Release of the plurality of vanes will result in the operation of the hydraulic device 10 as a couple and/or as a hydraulic pump as is discussed in further detail in one or more of the previously incorporated references. Hydraulic pressure to the ports 26, 28 (and chambers including chamber 32) can be controlled through pressure regulators or other known methods. Control of pressure in the hydraulic device 10 can be effected by, for example, controlling a balanced piston as described in US Patent Application Publication No. 2013/00067899.

FIG. 1B provides an enlarged view of the first and second ports 26, 28, the cavity 30, and the chamber 32 relative to the rotor 16, the first vane 16A, the second vane 16B, the ring 18, and the first side plate 20. As previously discussed, the first and second ports 26, 28 are defined by the first side plate 20, the ring 18, and the rotor 16 (including the plurality of vanes). As shown in FIG. 1B, the cavity 30 can be configured to allow the hydraulic fluid to be disposed radially outward of at least a portion of the at least one of the plurality of vanes (e.g., the first vane 161) when the at least one of the plurality of vanes is transiting the first port 26. Similarly, a second cavity (not shown) can be configured to allow the hydraulic fluid to be disposed radially outward of at least a portion of the at least one of the plurality of vanes (e.g., the second vane 16B) when the at least one of the plurality of vanes is transiting the second port 28. In the example of FIG. 1B, the cavity 30 can extend axially along and can be defined by an inner surface of the ring 18 as well as being defined by the rotor 16.

Figure 2:
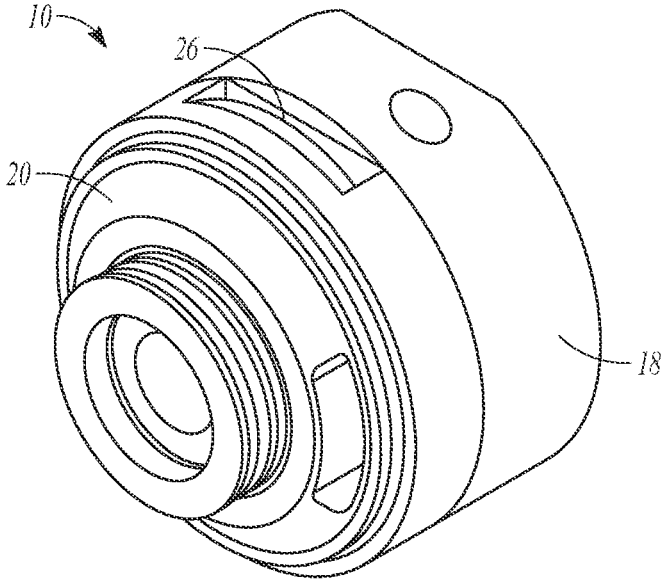
FIG. 2 is a perspective view of a side plate and a ring according to an example embodiment of the present application.
Figure 2A:
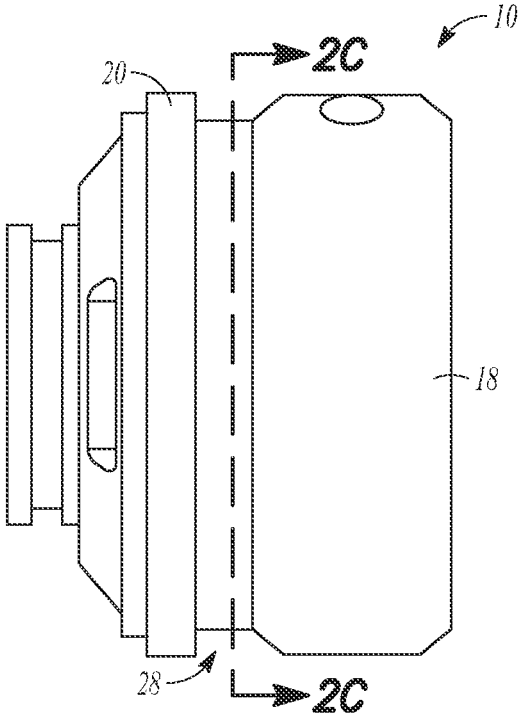
FIG. 2A is a plane view of the side plate and the ring of FIG. 2, according to an example of the present application.
Figure 2B:
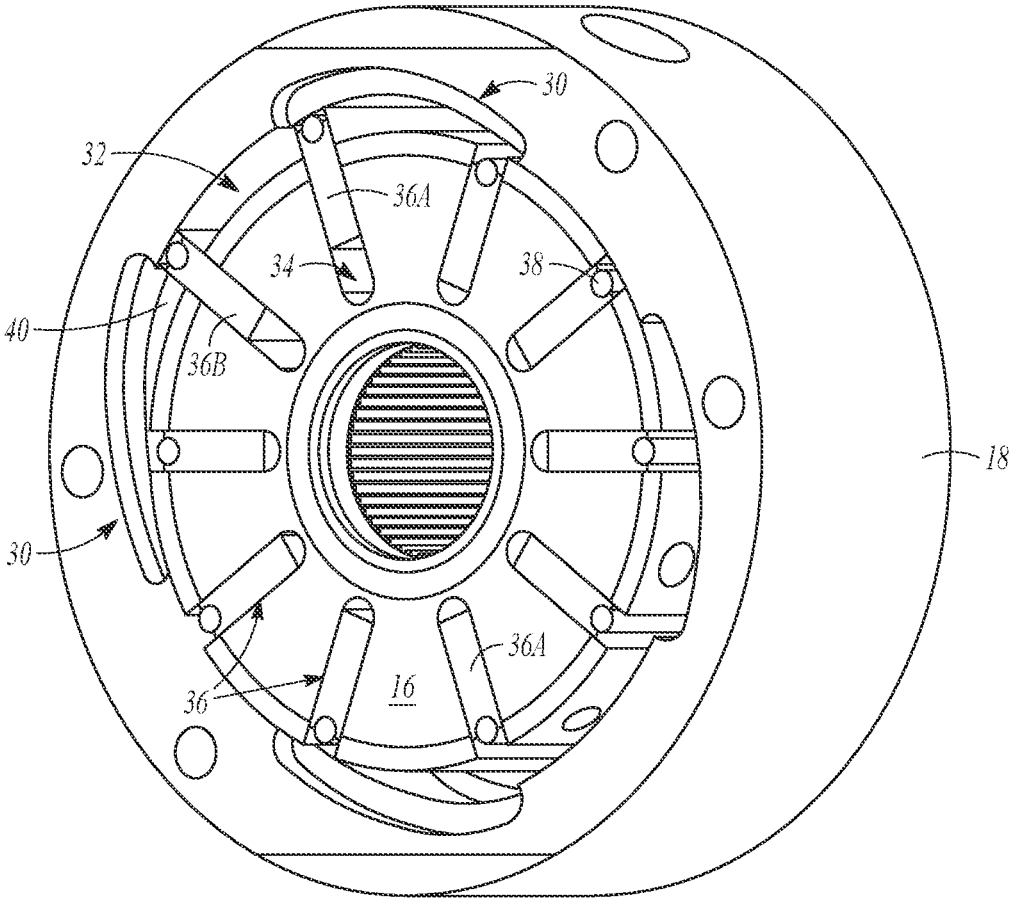
FIG. 2B is a perspective view with the side plate removed showing the ring with chamfered inner surface, a rotor, and a plurality of vanes according to an example of the present application.

FIGS. 2 and 2A provide further views of the first side plate 20 and the ring 18 of the hydraulic device 10 assembled together with other components such as the housing 24 and the input shaft 12 removed. The first port 26 is also shown in both FIGS. 2 and 2A. The second port 28 is shown only in FIG. 2A.

FIG. 2B shows an example of the ring 18 along with other components. In FIG. 2B, the first side plate 20 has been removed to illustrate the rotor 16, the cavity 30, the chamber 32, the slots 34, and the plurality of vanes 36. According to the example of FIG. 2B, the plurality of vanes 36 comprise roller vanes, each vane having a roller 38 at an outer radial tip thereof. The ring 18 includes an inner surface 40.

As shown in FIG. 2B, the rotor 16 and the plurality of vanes 36 can be disposed within the ring 18. As discussed previously, each of the plurality of vanes 36 is received in and is movable within one of the plurality of slots 34. The plurality of vanes 36 can be extended to interface with the ring 18.

FIG. 2B further illustrates the cavity 30 which can comprise a chamfered (i.e. machined) or otherwise formed portion of the inner surface 40 of the ring 18. The cavity 30 can extend axially along and can be defined by an inner surface of the ring 18 as well as being defined by the rotor 16. According to further examples, the cavity 30 can extend along an inner circumference of the ring 18 for a distance sufficient to accommodate at least two of the plurality of vanes (e.g., vanes 36A and 36B) when the at least two of the plurality of vanes 36 are transitioning the port 26. As discussed previously, the chamber 32 can be defined between the ring 18 and the rotor 16.

In FIG. 2B, some of the plurality of vanes 36 (e.g., vanes 36A and 36B) are depicted in a vane extended position interfacing with the inner surface 40 of the ring 18 while others (e.g., vane 36C) are shown in a vane retracted position within the slots 34. This positioning is done for illustration purposes only. In operation, all of the plurality of vanes 36 would be positioned either in the vane extended position or the vane retracted position.

Figure 2C:
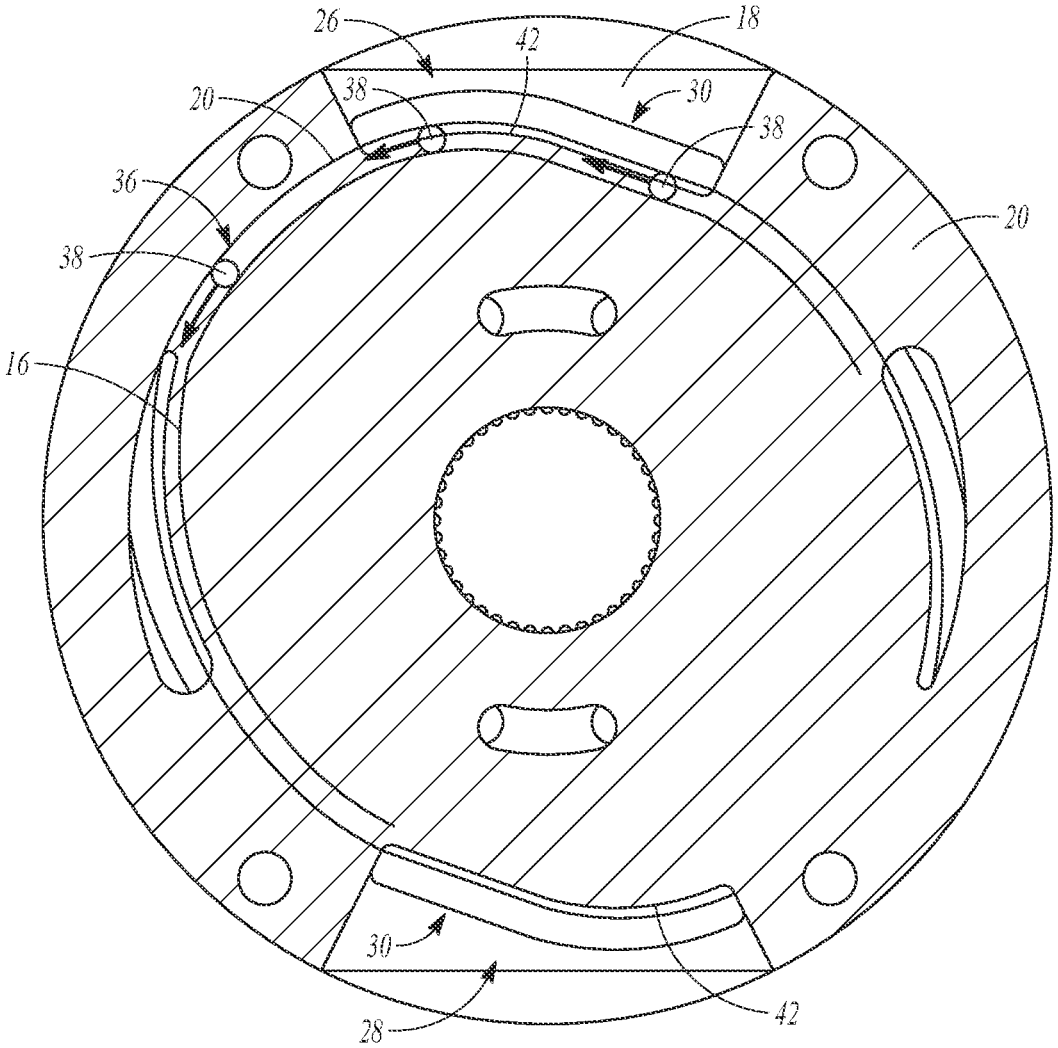
FIG. 2C is a cross-sectional view through the side plate along the section 2C-2C of FIG. 2 according to an example of the present application.

FIG. 2C is a cross-section through the first side plate 20 showing only portions of the ring 18 and the rotor 16 (in phantom). In addition to illustrating the first and second ports 26, 28, FIG. 2C shows that multiple cavities 30 can be created by chamfers (or other methods) in the inner surface 40 of the ring 18, FIG. 2C further illustrates that in some examples the side plate 20 can include a rail 42 that is configured to provide an axial stop for the roller 38 of each of the roller vanes. In particular, the rail 42 can ensure that the first side plate 20 always supports and retains the roller 38 from axial movement relative to the port (e.g., the first port 26). FIG. 21) shows the rail 42 (part of the first side plate 20) axially supporting and capturing the roller 38 of a single vane of the plurality of vanes 36.

Figure 2D:
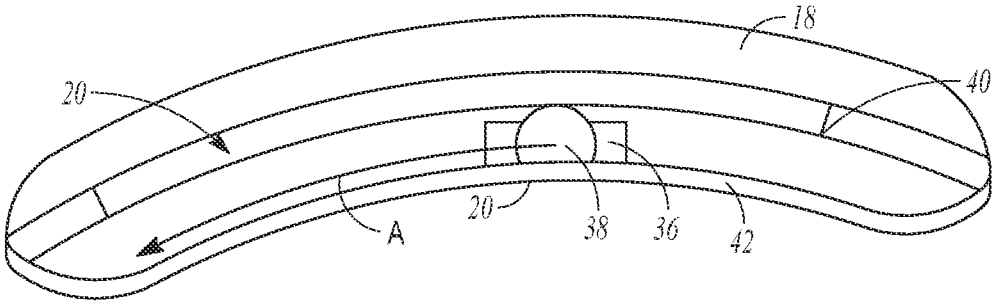
FIG. 2D provides an enlarged cross-sectional view showing the side plate configured to capture the roller according to an example of the present application.

More particularly, FIGS. 2C and 2D illustrate one or more rollers 38 moving relative to the side plate 20 and the ring 18 as indicated by arrows A. The roller(s) 38 interface with and move along the inner surface 40 of the ring 18. In the vicinity of the first port 26, the rollers 38 abut the rail 42 at the axial end thereof. The rail 42 can extend radially and circumferentially along the path of the rollers 38 to provide the axial stop for the rollers 38 along the entire length of the port 26.

Figure 3:
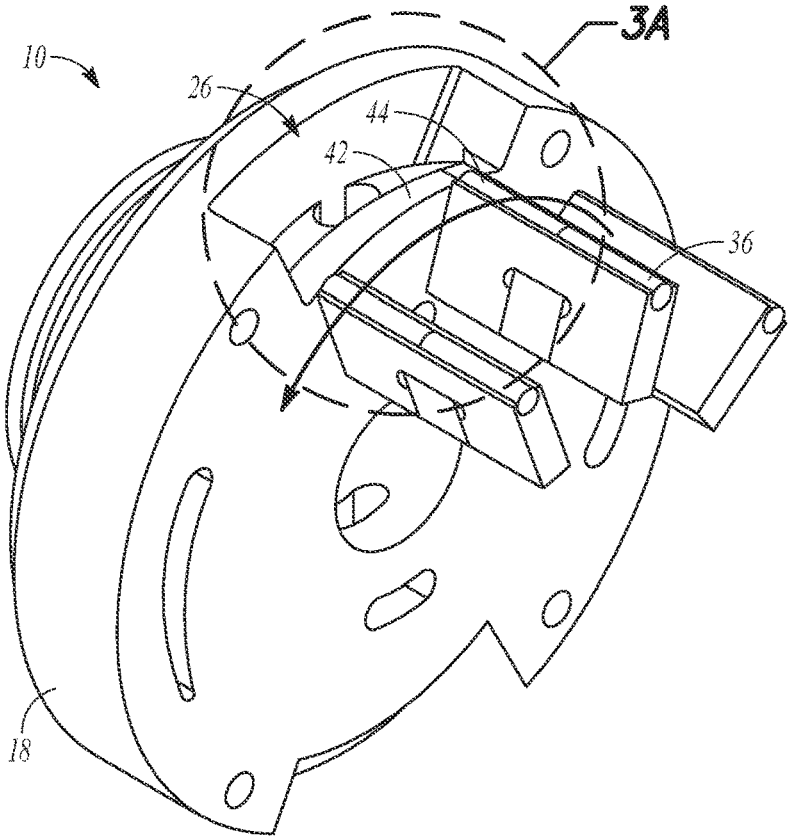
FIG. 3 is a perspective view of the side plate and several of the plurality of vanes according to an example of the present application.
Figure 3A:
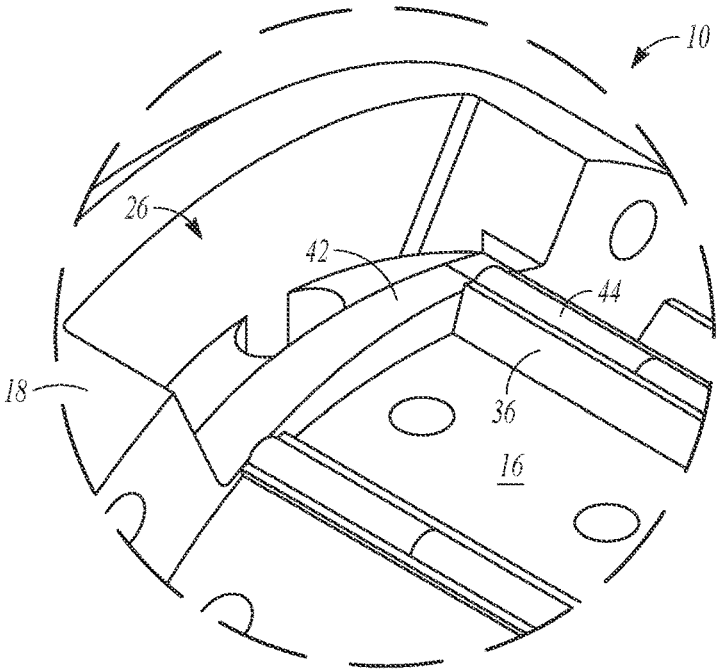
FIG. 3A is an enlarged view of a port of FIG. 3 showing a rail according to an example of the present application.

The rail 42 is further illustrated in FIGS. 3 and 3A and is shown relative to several of the plurality of vanes 36. As shown in FIG. 3, the rail 42 comprises a projection that can be disposed within the port 26 axial to and adjacent the rotor 16 (FIG. 3A only) and the plurality of vanes 36. In particular, the rail 42 can be disposed between the port 26 and the plurality of vanes 36. In FIGS. 3 and 3A, as with prior examples, the plurality of vanes 36 comprise roller vanes each of the roller vanes having a vane cavity 44 on an outer radial end (tip). Each roller 38 (FIG. 2C) can be configured to be received in the corresponding vane cavity 44. In FIGS. 3 and 3A, the rollers 38 (FIG. 2C) have been removed for illustrative purposes to show the vane cavities 44. As is best illustrated in FIG. 3A but also illustrated in FIGS. 3 and 2C, in some cases the rail 42 may have a changing radial height along substantially an entire circumferential length thereof in the port 26.

Figure 4:
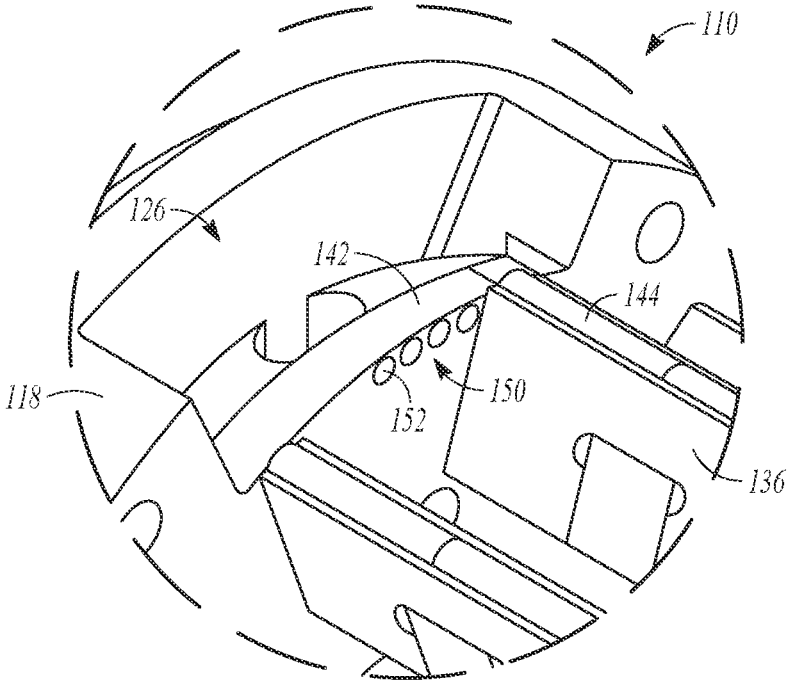
FIG. 4 is an enlarged view of a port showing the rail with holes therethrough according to an example of the present application.

FIG. 4 illustrates another example of a hydraulic device 110 with a port 126, a side plate 120, and a plurality of vanes 136 similar to those previously discussed. The hydraulic device 110 can additionally include a rail 142 similar to that previously discussed but further including one or more passages 150 that allow for a flow of hydraulic fluid through the rail 142 to or from the port 126. The one or more passages 150 can be disposed radially inward of the vane cavities 144 and roller (not shown). In the example of FIG. 4, the one or more passages 150 can comprise a plurality of holes 152 that extend generally axially through the rail 142 and communicate with the port 126 as well as the chamber (not shown).

Figure 5:
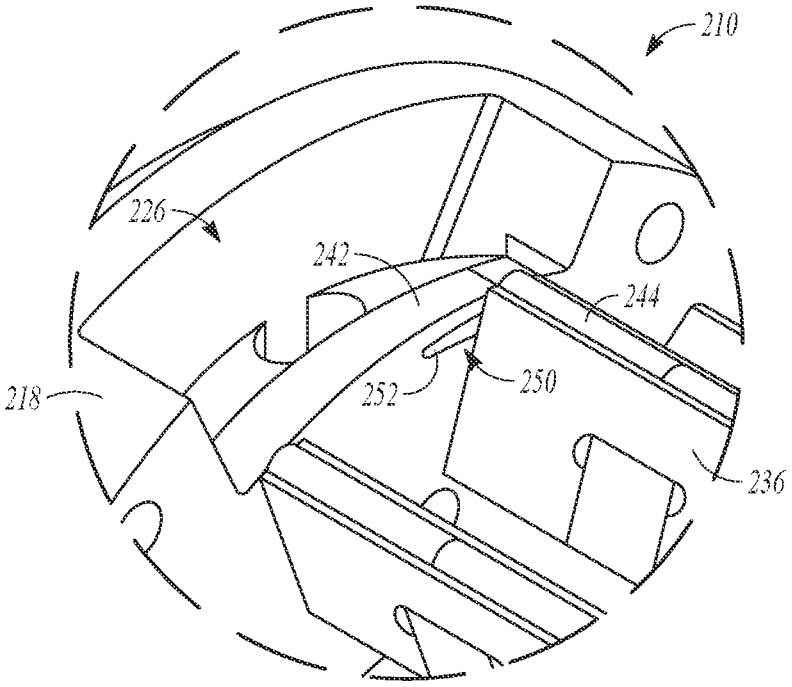
FIG. 5 is an enlarged view of a port showing the rail with a slot therethrough according to an example of the present application.

FIG. 5 shows another example of a hydraulic device 210 with a port 226, a side plate 220, and a plurality of vanes 236 similar to those previously discussed. The hydraulic device 210 can additionally include a rail 242 similar to that previously discussed but further including one or more passages 250 that allow for flow of hydraulic fluid through the rail 242 to or from the port 226. The one or more passages 250 can be disposed radially inward of the vane cavities 244 and roller (not shown). In the example of FIG. 5, the one or more passages 250 can comprise a slit 252 that has a geometry that changes along a circumferential length of the port 226 and that extends generally axially through the rail 242. The slit 252 allows for communication between the port 226 and the chamber (not shown).

The relief provided by the chamfer that creates the cavity which can help to accommodate for the area replaced by addition of the rail (42, 142, 242) to the port. Furthermore, the propose designs for the ring and the side plate can prevent axial shifting or movement of the rollers while still allowing hydraulic fluid to flow to or from adjacent the rotor.

The disclosed hydraulic devices can allow for benefits such as reducing peak transient forces experienced by the powertrain, reduced hydraulic noise, greater fuel efficiency, reduced emissions, among other benefits.

Other examples not specifically discussed herein with reference to the FIGURES can be utilized. The disclosed devices are applicable to various types of vehicles such as earth moving equipment (e.g., wheel loaders, mini-loaders, backhoes, dump trucks, crane trucks, transit mixers, etc.), waste recovery vehicles, marine vehicles, industrial equipment (e.g., agricultural equipment), personal vehicles, public transportation vehicles, and commercial road vehicles (e.g., heavy road trucks, semi-trucks, etc.).

Although specific configurations of devices are shown in FIGS. 1-5 and particularly described above, other designs that fall within the scope of the claims are anticipated.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls. In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

This application claims the benefit of priority to U.S. Provisional Patent Application Ser. No. 62/270,327, filed 21 Dec. 2015, the disclosure of which is incorporated herein in its entirety by reference.

The claimed invention is:

1. A hydraulic device comprising:

a rotor disposed for rotation about an axis, the rotor having a plurality of roller vanes extending therefrom, wherein the each of the plurality of roller vanes have a roller;

a ring disposed at least partially around the rotor, the ring and rotor in communication with a port for egress of a hydraulic fluid from a chamber adjacent the rotor, wherein the chamber is positioned between the rotor and the ring, wherein the ring further defines a cavity adjacent to and in communication with the port, wherein the cavity is positioned radially outward of and in communication with the chamber; and a rail disposed within the port axial to and adjacent the rotor, wherein the rail has a chamfered surface positioned radially inward of a tip of each of the plurality of roller vanes, and wherein the rail is configured to provide an axial stop for the roller of each of the plurality of roller vanes.

2. The hydraulic device of claim 1, wherein the hydraulic device comprises a variable vane device.

3. The hydraulic device of claim 1, wherein the cavity is further defined by the rotor and is configured to allow the hydraulic fluid to be disposed radially outward of at least a portion of the at least one of the plurality of roller vanes when the at least one of the plurality of roller vanes is transiting the port.

4. The hydraulic device of claim 1, wherein the cavity extends axially along the inner surface of the ring for a distance.

5. The hydraulic device of claim 1, wherein the cavity extends along an inner circumference of the ring for a distance sufficient to accommodate at least two of the plurality of vanes when the at least two of the plurality of roller vanes are transitioning the port.

6. The hydraulic device of claim 1, wherein the rail defines one or more passages that allow for a flow of hydraulic fluid through the rail to the port.

7. The hydraulic device of claim 6, wherein the one or more passages are disposed radially inward of a vane pocket and the roller.

8. The hydraulic device of claim 1, wherein the rail is formed by a side plate that additionally defines a portion of the port.

9. The hydraulic device of claim 1, wherein the chamfered surface is positioned radially inward of a majority of each roller.

10. A hydraulic device comprising:

a side plate defining at least a portion of a port and a rail, the rail disposed within the port;

a rotor disposed for rotation about an axis and disposed axial to and adjacent the side plate;

a plurality of roller vanes configured to extend from the rotor, wherein each of the plurality of roller vanes have a roller received in a vane pocket at an outer radial end thereof; and a ring disposed at least partially around the rotor, the ring and rotor in communication with the port for egress of the hydraulic fluid from a chamber adjacent the rotor, wherein the chamber is positioned between the rotor and the ring, wherein the ring defines a cavity adjacent to and in communication with the port, wherein the cavity is positioned radially outward of and in communication with the chamber and the cavity is disposed radially outward of the plurality of roller vanes;

wherein the rail is positioned axial and adjacent to the rotor, wherein the rail has a chamfered surface positioned radially inward of the outer radial end of each of the plurality of roller vanes, and wherein the rail is configured to provide an axial stop for the roller of each of the roller vanes.

11. The hydraulic device of claim 10, wherein the hydraulic device comprises a variable vane device.

12. The hydraulic device of claim 10, wherein the cavity is configured to allow the hydraulic fluid to be disposed radially outward of at least a portion of the at least one of the plurality of roller vanes when the at least one of the plurality of roller vanes is transiting the port.

13. The hydraulic device of claim 10, wherein the cavity extends axially along the inner surface of the ring for a distance.

14. The hydraulic device of claim 10, wherein the cavity extends along an inner circumference of the ring for a distance sufficient to accommodate at least two of the plurality of roller vanes when the at least two of the plurality of roller vanes are transitioning the port.

15. The hydraulic device of claim 10, wherein the rail defines one or more passages that allow for a flow of hydraulic fluid through the rail to the port.

16. The hydraulic device of claim 15, wherein the one or more passages are disposed radially inward of the vane pocket and the roller.

17. The hydraulic device of claim 10, wherein the chamfered surface is positioned radially inward of a majority of each roller.

18. A hydraulic device comprising:

a rotor disposed for rotation about an axis;

a plurality of roller vanes configured to extend from the rotor, wherein the plurality of roller vanes have a roller received in a vane pocket at an outer radial end thereof, a side plate disposed axial to and adjacent the rotor, the side plate defining at least a portion of a port and a rail, wherein the rail disposed within the port axial to and adjacent the rotor, wherein the rail has a chamfered surface positioned radially inward of the outer radial end of each of the plurality of roller vanes, wherein the rail is configured to provide an axial stop for the roller of each of the roller vanes; and a ring disposed at least partially around the rotor, the ring and rotor in communication with the port for egress of the hydraulic fluid from a chamber adjacent the rotor, wherein the chamber is positioned between the rotor and the ring, wherein the ring defines a cavity adjacent to and in communication with the port, wherein the cavity is positioned radially outward of and in communication with the chamber and the cavity is disposed radially outward of the plurality of roller vanes.

19. The hydraulic device of claim 18, wherein the chamfered surface is positioned radially inward of a majority of each roller.

* * * * *